US007070233B2

(12) United States Patent
Laffin

(10) Patent No.: US 7,070,233 B2
(45) Date of Patent: Jul. 4, 2006

(54) BODY SUPPORT CHAIR WITH ADJUSTABLE HANDLES

(75) Inventor: Francois Xavier Laffin, Sion (CH)

(73) Assignee: Lifestand International SA, Sion (CH)

( * ) Notice: Subject to any disclaimer, the term of this patent is extended or adjusted under 35 U.S.C. 154(b) by 0 days.

(21) Appl. No.: 10/870,432

(22) Filed: Jun. 18, 2004

(65) Prior Publication Data

US 2005/0006878 A1 Jan. 13, 2005

(30) Foreign Application Priority Data

Jun. 19, 2003 (FR) ..... 03 07409

(51) Int. Cl.
*A47C 4/52* (2006.01)

(52) U.S. Cl. ..... 297/183.9; 297/DIG. 4; 297/DIG. 10; 280/250.1

(58) Field of Classification Search ..... 297/DIG. 10, 297/DIG. 4, 316, 330, 340, 183.1, 183.9; 280/250.1, 642
See application file for complete search history.

(56) References Cited

U.S. PATENT DOCUMENTS 4,519,649 A * 5/1985 Tanaka et al. ..... 297/316
4,569,556 A * 2/1986 Pillot ..... 297/316
4,598,944 A 7/1986 Meyer et al.
4,623,194 A 11/1986 Pillot
5,108,202 A * 4/1992 Smith ..... 297/330
5,556,121 A * 9/1996 Pillot ..... 280/304.1
6,244,662 B1 * 6/2001 Porcheron ..... 297/383
6,250,717 B1 * 6/2001 Porcheron ..... 297/411.3
6,440,046 B1 8/2002 Tholkes

FOREIGN PATENT DOCUMENTS

FR 2769830 4/1999

* cited by examiner

*Primary Examiner*—Milton Nelson, Jr.
(74) *Attorney, Agent, or Firm*—Dennison, Schultz & MacDonald

(57) ABSTRACT

A body support chair having two symmetrical lateral articulated systems, each having a first deformable polygon, a second deformable polygon, a back assembly articulated on the first quadrilateral, and a maneuvering assembly interposed between the first polygon and the frame which includes a first lever articulated on the rear part of the frame, a second lever with two ends, one end being articulated on the first lever and the other end being articulated on the first polygon and a maneuvering handle which is attached to the second lever and a maneuvering assembly which is interposed between the first polygon and the frame and which comprises a maneuvering handle which is attached. The chair is characterized in that for each maneuvering assembly, the position of the maneuvering handle is adjustable between the ends of the second lever.

8 Claims, 5 Drawing Sheets

BODY SUPPORT CHAIR WITH ADJUSTABLE HANDLES

The present invention relates to chairs used by the physically challenged and disabled and it includes independently wheelchairs, whether or not folding, manually or electrically propelled.

More particularly, the invention relates to chairs, so called "verticalizers", which make it possible for their user to occupy a sitting or standing position. This type of chair such as, for example, that described in patent FR 2 769 830, comprises a chassis supporting an articulated structure that comprises a seat as well as two symmetrical lateral articulated systems assuring verticalization—lowering function of the seat, the back and of the foot rest in order to make it possible for the user of the chair to move from a sitting position to a standing position.

For this purpose, each lateral articulated system comprises a first polygon or quadrilateral contributing to the support of the seat and comprised of two sills, top and bottom, respectively, articulated on a front part of the chassis and connected at their rear part by a spacer part.

Each lateral articulated system comprises also a second deformable polygon or quadrilateral contributing to the support of the foot rest as well as a back assembly articulated on the first quadrilateral facing the second quadrilateral, by means of the spacer part, at least Finally, each articulated lateral system comprises a maneuvering assembly interposed between the first quadrilateral and the frame which comprises on the one hand a first lever articulated on the rear part of the frame and at the end of a second lever, whose other end is articulated on the first quadrilateral, as well as a maneuvering handle attached to the second lever. The maneuvering handle assumes a guiding and control function and of the relative pivoting of the lateral system from a lowering position to a verticalization position of the structure relative to the frame and vice versa.

The maneuvering assembly comprises, on the other hand, an element assisting in the raising—verticalization movement such as, for example, a pneumatic jack. In order to provide for easy gripping regardless of the articulated structure, the maneuvering handle provides a U-shaped gripping zone, open at its center, having two arms connected by a bar and all three offering a support back for the palm of the user's hand.

This type of body—support chair satisfies all of the requirements relating to its verticalization—lowering function as to the user who is capable of moving from a seated position to a standing position without assistance, human or mechanical, other than that provided by the pneumatic jack.

However, despite the satisfaction provided by the great ease in moving to the two positions, of precisely positioning each maneuvering handle for adapting to the morphology of the user and providing him with the possibility of best developing its force in the verticalization movement, in the course of which the action on the maneuvering handle corresponds to the rolling movement of the hand when manually rolling the chair.

In order to address this need for comfort while preserving the standardized design of the body support chair making it possible to reduce the manufacturing costs, the invention proposes a novel body support chair for the physically challenged and disabled comprising a frame supporting an articulated structure which comprises a seat, a foot rest, a back, as well as two symmetrical lateral articulated systems, each comprising:

a first deformable polygon or quadrilateral contributing to the support of the seat, comprising two sills, upper and lower, respectively articulated on the front part of the frame and connected towards their rear parts by a spacer part;

a second deformable polygon or quadrilateral contributing to the support of the foot rest;

a back assembly articulated on the first quadrilateral, opposite to the second quadrilateral, by means of the spacer part, at least;

and a maneuvering assembly interposed between the first quadrilateral and the frame, which comprises on the one hand a first lever articulated on the rear part of the frame and at the end of a second lever, whose other end is articulated on the first quadrilateral, as well as a maneuvering handle attached to the second lever and assuming the function of guidance and control of the relative pivoting of the lateral systems from a lowered position to a verticalization position of the structure relative to the chassis and vice versa.

According to the invention, this novel body support chair is characterized in that for each maneuvering assembly, the position of the maneuvering handle is adjustable between the extremities of the second lever.

This ease of adjustment makes it possible to optimally position the maneuvering handle so that it is easily accessible without impairing the movements of the user of the chair, especially in the sitting position.

The adjustment of the position of the maneuvering handle can be realized in any suitable fashion and, according to one feature of the invention, the maneuvering handle comprises a body fitted on a support, whose position is adjustable between the two ends of the second lever.

According to a preferred but not strictly necessary embodiment, the body support chair according to the invention comprise both means for adjusting the position of the handle support, a series of fastening holes arranged in the second lever and into which the support is fastened by means of screw elements.

Such a series of holes thus makes it possible to discretely adjust the position of the support of the body of the maneuvering handle.

Obviously, it is conceivable to use means making possible continuous adjustment of the position of the maneuvering handle between the two ends of the lever. This type of continuous adjusting means could be, for example, realized by means of one or a plurality of oblong holes arranged in the second lever and into which the handle support would be fastened by means of screw elements.

According to another feature of the invention, in order to free up the lateral space of the chair, apart from the verticalization-lowering movement phases, it is proposed to fit the body of the handle of the maneuvering handle on the support attached to the second lever in such a fashion that the body of the handle is mobile between a resting position, wherein the maneuvering handle is situated interposed between the seat and the corresponding wheel, and a working or deployed position, wherein the maneuvering handle is easily accessible.

According to one feature of the invention, the maneuvering handle is mobile relative to the support in rotation along a horizontal axis essentially included in the frontal plane.

According to another feature of the invention, the body support chair comprises means for locking the maneuvering handle into one or the other of these two positions, working or resting.

According to yet another feature of the invention, the maneuvering handle has a U-shaped gripping zone that is open its center and has two arms connected by a bar, all three offering a support surface for the palm of the hand or the fingers of a user.

According to still another feature of the invention, one at least of the maneuvering handles comprises a control member of an assistance element for the verticalization—lowering movement equipping each of the maneuvering assemblies.

Various other features of the invention will become apparent from the description that follows with reference to the annexed drawings which show a preferred, non-limiting embodiment of a body support chair for the physically challenged or disabled comprising an adjustable position handle according to the invention.

Figure 1:
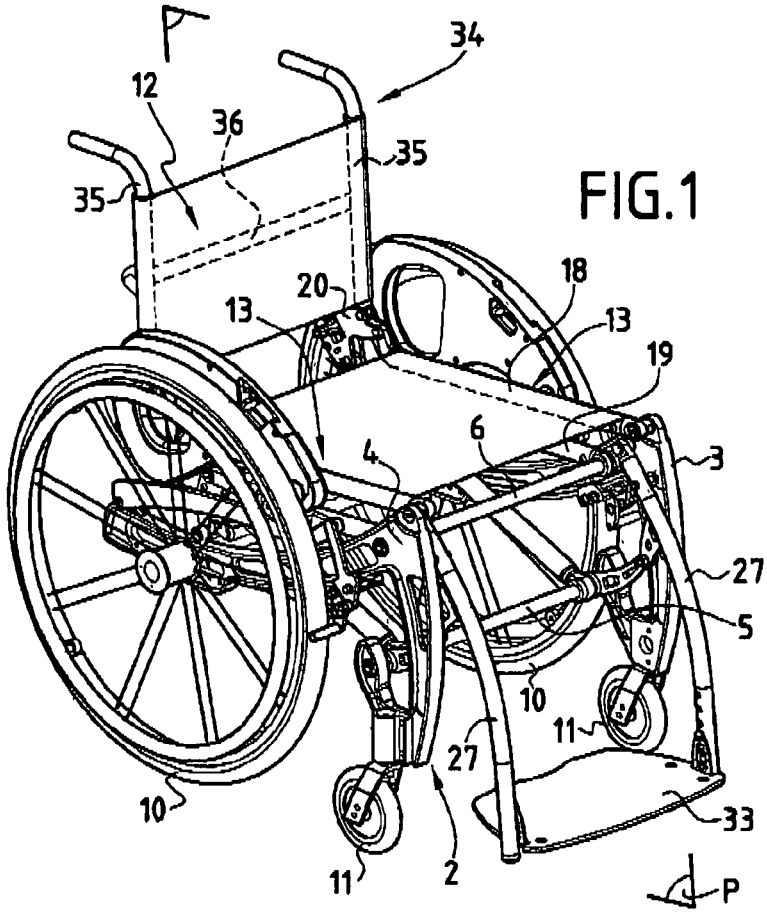
FIG. 1 represents a perspective view of a body support wheelchair according to the invention.
Figure 2:
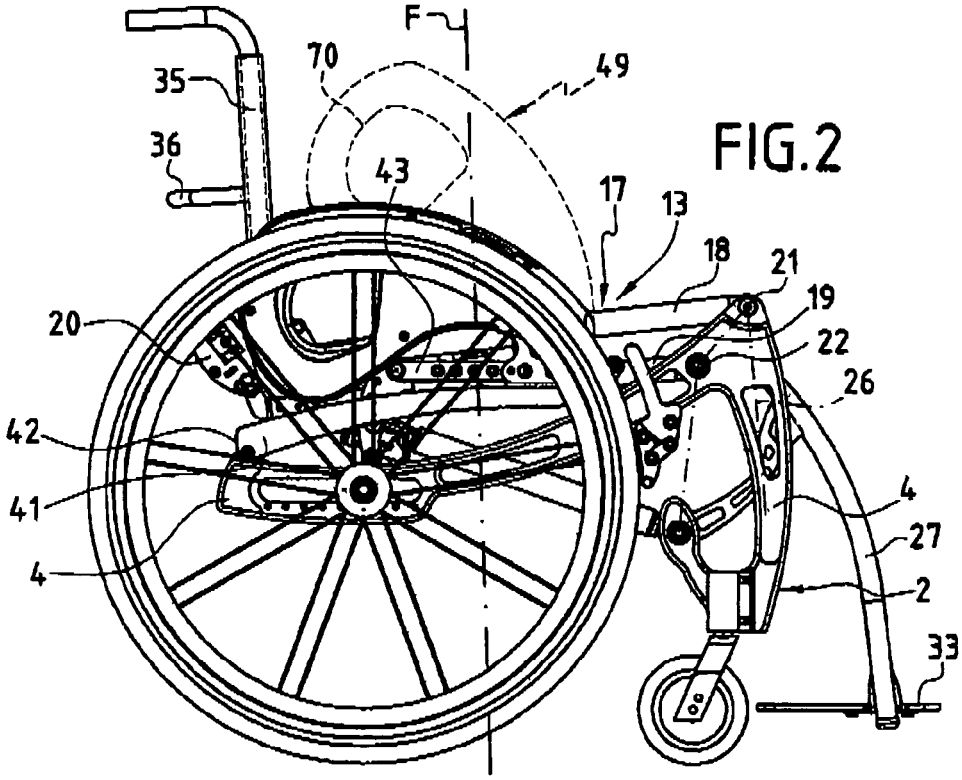
FIG. 2 is an elevation in right-sided view of the chair illustrated in FIG. 1 in the lowered sitting position of the chair.
Figure 3:
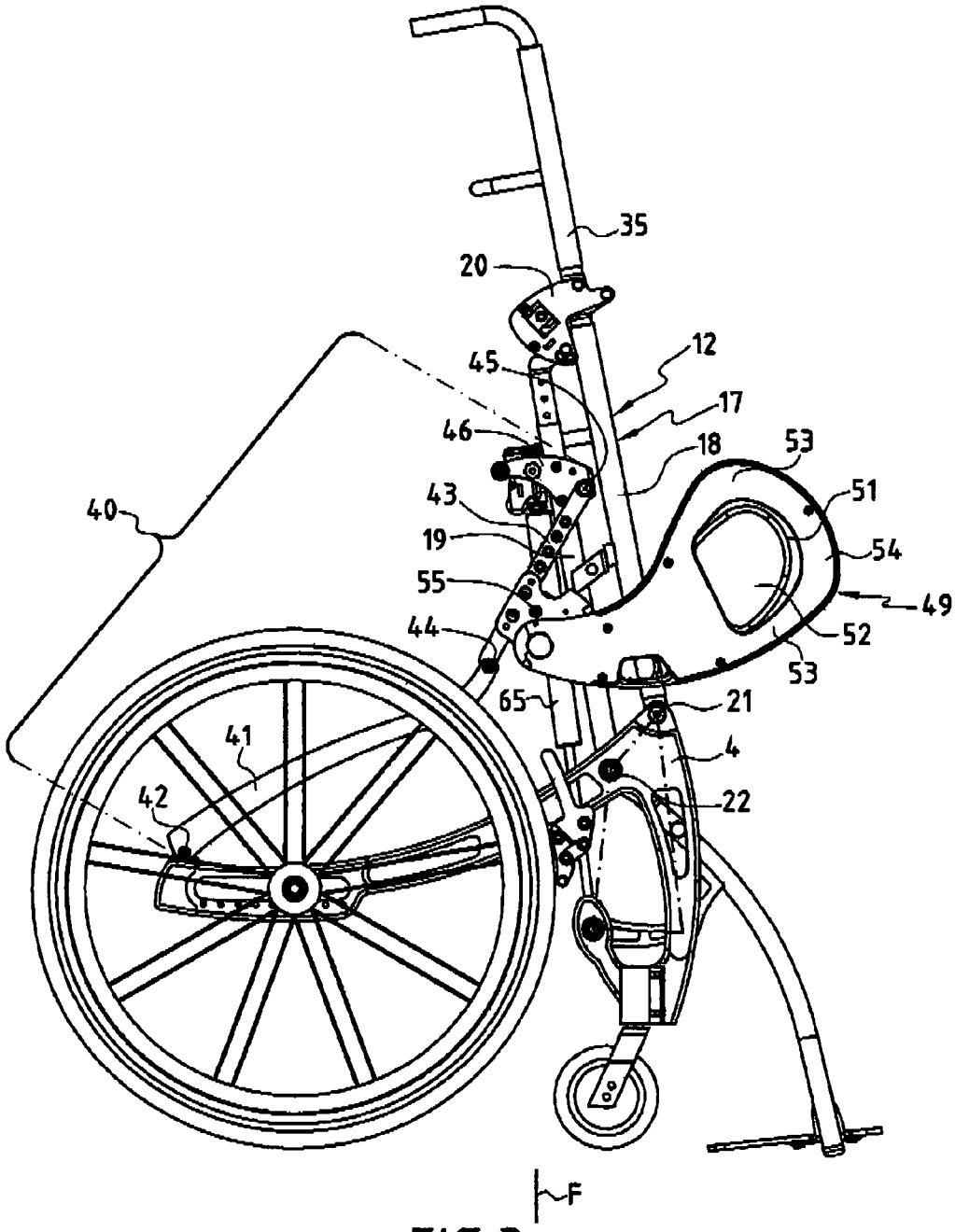
FIG. 3 is a partial elevation, similar to FIG. 2, of the chair in the verticalization or upright position.

The invention proposes enhancing the capacities of adaptation of a body support wheelchair as illustrated in FIGS. 1 to 3 to the morphology of its user.

This type of chair comprises a frame, comprised of lateral hemi-frames 3 and 4, connected together by cross-members 5 and 6. These different constituent elements define a supporting assembly provided with driving wheels 10 and orientable steering wheels 11.

As illustrated, the frame 2 corresponds to a rigid design chair but it is quite obvious that a substantially similar conformation could be used for a foldable chair. In fact, in such a case, the rigid cross-members 5 and 6 are then replaced by flexible elements of known design.

The frame 2 described hereinbefore is equipped with a verticalizer device, which is realized in the form of an articulated structure 12 supported by the frame 2. The articulated structure 12 is comprised by two symmetrical lateral articulated systems symmetrical relative to a sagittal plane P and which are more particularly visible in FIGS. 2 and 3. Each articulated system 13 is intended to be attached laterally to the frame 2 at each of the hemi-frames 3 and 4, for example.

Each articulated system 13 comprises a first deformable polygon and, according to the example, deformable quadrilateral 17 comprised of two sills 18 and 19, respectively called top and bottom, although they are not—in the representation shown in FIG. 3—disposed in the same vertical plane. The sills 18 and 19 are connected at their rear end part by an spacer element or spacer part 20 and are mounted on the frame 2 in the vicinity of the front part of said latter by a first articulation point 21 relating to the top sill and by a second articulation point 22 relating to the bottom sill. In the present case, the point of articulation 21 is provided in the top part of the corresponding hemi-frame 3, 4 while the point of articulation 22 is situated on this same hemi-frame behind and below the point of articulation 21.

In the illustrated example, the spacer element 20 is provided for corresponding to the distance separating the points of articulation 21 and 22 such that the quadrilateral 17 has the preferred form of a deformable parallelogram, without said form being considered as necessary to the embodiment of a chair according to the invention.

Each articulated system 13 comprises in addition a second deformable polygon 26, in this instance a deformable quadrilateral drawn in FIGS. 2 and 3 in dotted and dashed lines, connecting the first deformable quadrilateral to a jamb or similar riser 27 intended for supporting, alone or in combination with a jamb or similar riser, a foot rest 33.

Finally, each articulated system 13 comprises a back assembly comprising two uprights, each of which articulated on the first quadrilateral 13, facing the second quadrilateral 26, by means of a spacer part 20. According to the example illustrated, the uprights 35 of the back are in addition connected by a cross-member 36.

In order to allow passage of the articulated structure 12 from the sitting lowered position—as shown in FIG. 2—to the verticalization or standing position—as illustrated in FIG. 3—each articulated system comprises a maneuvering assembly 40 interposed between the first quadrilateral 17 and the frame 2 and, more particularly, the corresponding hemi-frame 4.

Each maneuvering assembly 40 comprises a first lever 41, articulated on the rear part of the frame by means of a pivot 42 and, at the end of a second lever 43 by means of a pivot 44. The other end of the second lever 43 is thus articulated on the first quadrilateral and, according to the example shown, on the bottom sill 19 by means of a pivot 45 and a fixation part 46 attached to the second lever 43.

Each maneuvering assembly comprises also a maneuvering handle 49, which could be made universal to the extent that it must allow the user of the chair to apply a force on said handle, both in terms of the lowered or sitting position shown in FIG. 2 and in terms of the verticalization B shown in FIG. 3 and during the transition or verticalization—lowering movement.

Figure 4:
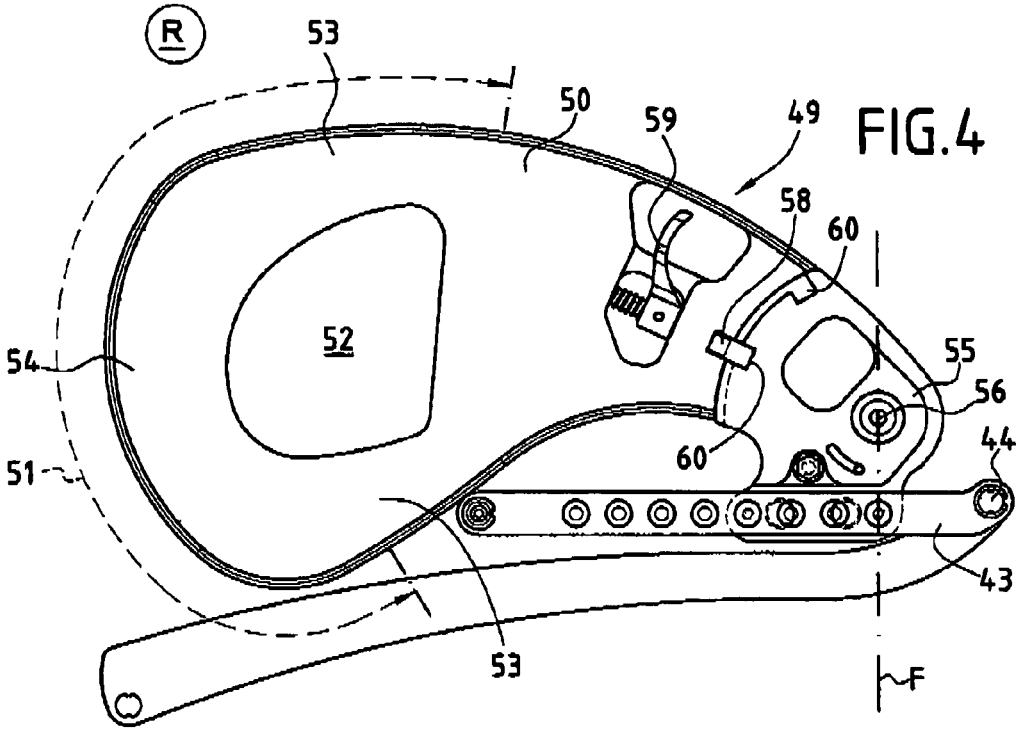
FIGS. 4 and 5 are elevations of a detail of an embodiment of the operating handle of the chair illustrated in FIG. 1.
Figure 6:
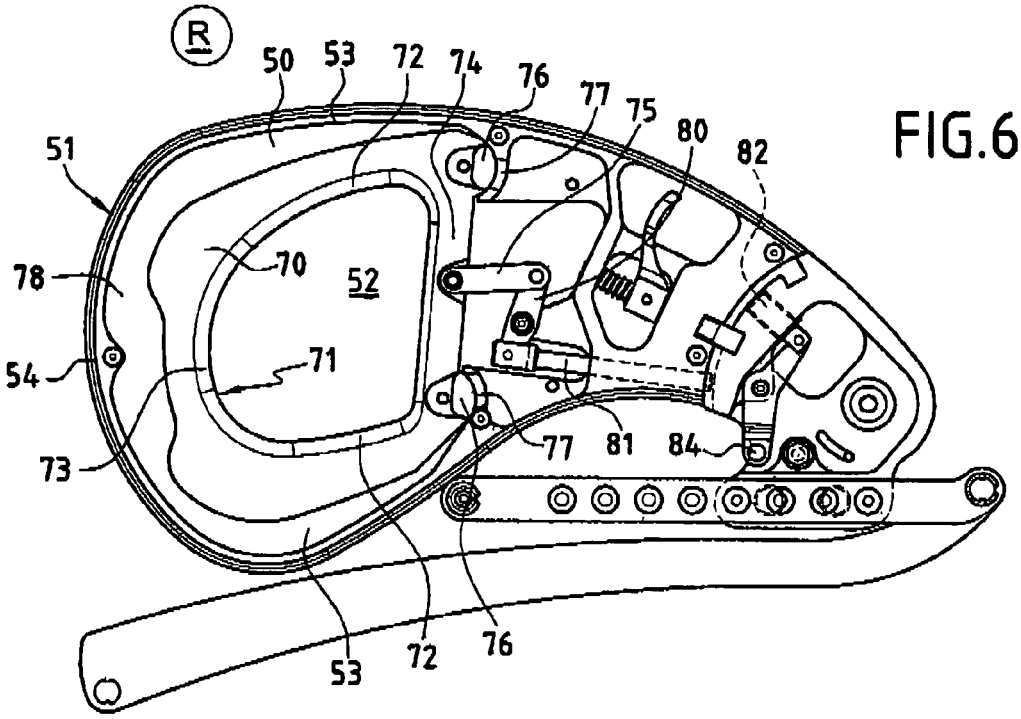
FIGS. 6 and 7 are elevations of a maneuvering handle of a chair according to the invention comprising a universal control member for an element for assistance in the verticalization—lowering movement.

To this end, each universal handle comprises—as shown in particular in FIGS. 4 and 6—a handle body 50 having a U-shaped gripping zone 51 that is open at its center 52. Thus the gripping zone 51 has two arms 53 connected by a bar 54. The arms 53 and the bar 54 thus provided, all three, a support back for the palm of the hand of the user who can furthermore enclose the handle by placing the fingers at its center 52.

Figure 5:
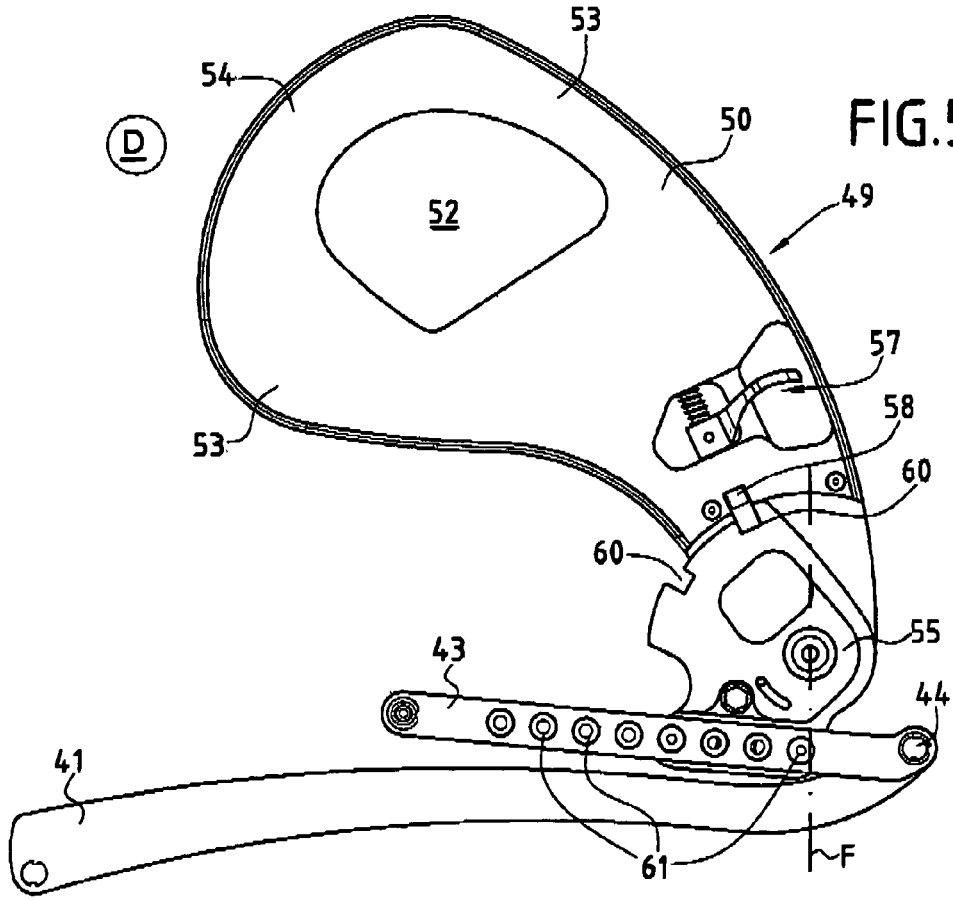

The body of the handle 50 is attached to the lever 43 as hereinbefore described by being affixed or moveable relative to said latter. According to the illustrated example and preferably but not strictly necessary, the body of the handle 50 is fitted on the second lever 43 by means of a support 55 so as to be mobile between a retracted or resting position R—as illustrated in FIGS. 1, 2 and 4 in solid lines—and a deployed or working position D—as illustrated in FIG. 2 in dotted lines and in FIG. 5 in solid lines. To this end, the body of the handle 50 is connected to the support 55 by a swivel 56 having a substantially horizontal axis and contained in a frontal plane F, perpendicular to the sagittal plane P.

The possibility of movement, alternating from the retracted or resting position R shown to the raised or working position D of the handle, makes it possible to disengage the lateral space of the user upon any movement of the articulated structure is undesirable, both in the sitting position and in the verticalization or standing position.

In order to assure the stability of the working position D or the resting position R of the maneuvering handle 50, said later is equipped with means 57 for locking the handle in the one or the other of its R or D positions. The means 57 can be realized in any suitable fashion and are—according to the example shown—comprised of a finger 58 maneuvered into position by a gate 59 and intended to be inserted, depending on its position into the one or the other of two holes 60 made in the support 55.

According to an essential characteristic of the invention, in order to make possible a perfect fit of the chair to the morphology of its user, the support 55 of the maneuvering handle 50 is adjustable as to its position on the second lever, so as to be placed at different intermediary positions between the two ends of said lever 43.

To this end, according to the illustrated example, the adjustment is assured by means of a series of holes 61 made in the lever 2 and making it possible to fix, by means of screws (not shown) the support 55 at different positions such that it is possible to extend or to contract it from the back as a function of the morphology of the user.

In order to facilitate the verticalization—lowering movement, the body support chair described hereinbefore also comprises assistance means 65. According to this example, said assistance means are comprised for each of the articulated systems of a gas jack interposed between the first quadrilateral 13 and the front part of the frame 2.

According to the illustrated example, each gas jack 65 incorporates also automatic blocking means which prevent any movement of the jack and thus of the articulated system to which it is connected, whilst an unblocking control is not applied to the blocking system of the blocking of the jack. Thus, it is necessary to provide the user of the chair with control means that are easy to use.

Thus, according to an characteristic of the invention, one at least of the two handles, preferably the one corresponding to the dominant hand of the user, comprises, as shown in FIGS. 6 to 9, a control member 70 which is arranged on the inside of the central opening 52 of the gripping zone of the body of the handle 50 and open at its center. Thus, the control member 70 comprises at its center an interior U-shaped gripping zone 71 corresponding to the gripping zone 51, which could be arranged external to the handle body 50 and having two arms 72 connected by a bar. The arms 72 and the bar 73 thus provide, all three, a zone of support for the fingers of the corresponding hand of the user.

According to the example shown, the control member 70 has, opposite to the bar 73, a cross-member 74 intended to make possible the fixation of an element to be controlled 75, which will be described in more detail below.

The control member 70 comprises, opposite to the bar and at one and the other end of the cross-member, two pivoting pins 76, with which two support surfaces 77 are associated and provided by the handle body 50. It should be noted that, according to the illustrated example, the control member 70 is arranged on the inside of the handle body 50 in a chamber 78 which is opened towards the center 52 of the gripping zone 51 of the handle 50. Thus, the control member 70 is enclosed in part at the inside of the body 50 of the handle; only its gripping zone 71 being accessible from the outside of the handle t its central opening 52.

Figure 7:
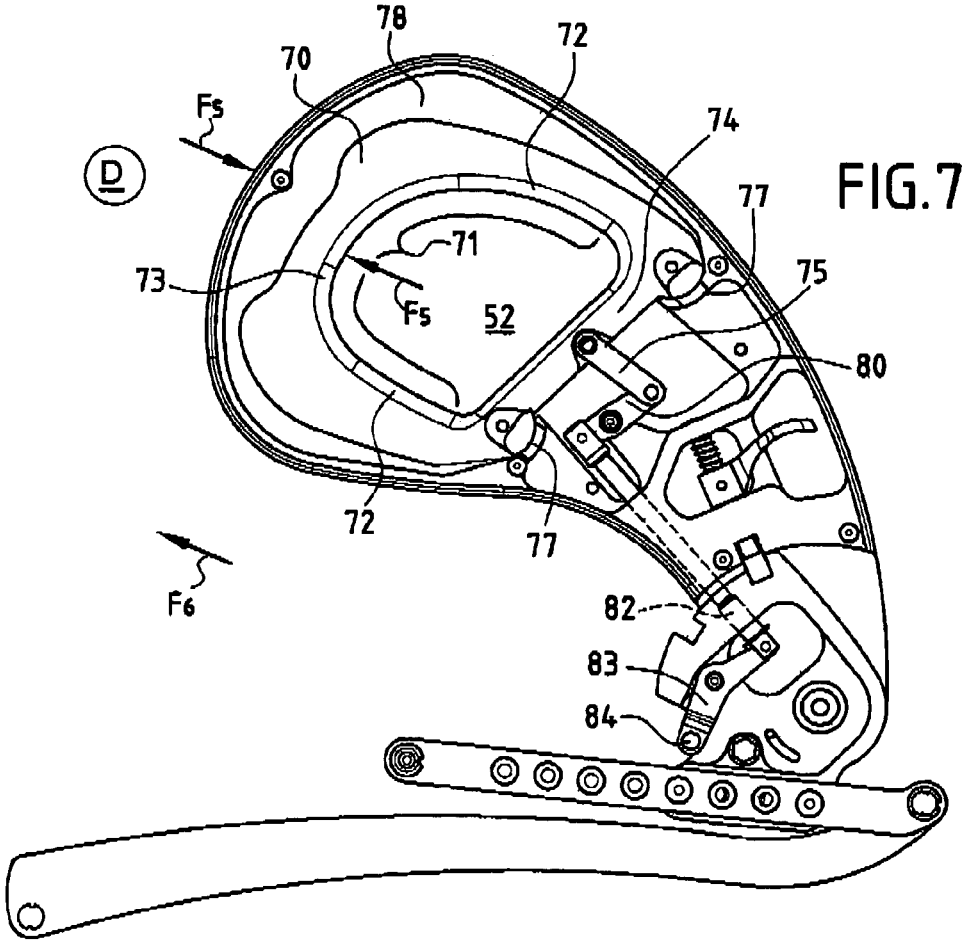

According to the illustrated example, the element to be controlled 75 is a rod connected by a pivot to one end of a joystick 80, whose other end acts upon a linkage 81. Said linkage 81 is situated, when the body of the handle 50 is in the working position D (as shown in FIG. 7) facing a pusher 82 likewise affixed to one end of a spacer 83 whose other end 84 is intended to be connected to a cable control device (not shown) either by being affixed to the cable itself of to the protective sheath, the cable control device then acting on the blocking means of the gas jack.

Considering the chain of movement transformation described above, it is necessary to exert a traction on the element to be controlled or the rod 75 in order to obtain an unblocking of the movement of the gas jacks. Now, the particular conformation of the control member 70 as well as, according to the illustrated example, the operation of the pivot pins 76 associated with the corresponding support surfaces 77, makes it possible to exert such traction regardless of the site where the universal handle is taken into the hand at the one or the other of the three gripping zones defined by the bar and the arms of the body of the handle 50 and the control member 70.

In addition, according to the illustrated example, the element assisting in the movement is a pneumatic system. However, it could be an electrical system that the control member could control either directly or indirectly by means of the linkage described hereinbefore, in order to conserve the coupling function.

In like fashion, a control member 70 using the two handles 49 of the chair could be envisaged so that the user could, indifferently, proceed with unblocking of the verticalization—lowering movement by means of his right hand or his left hand.

Figure 8:
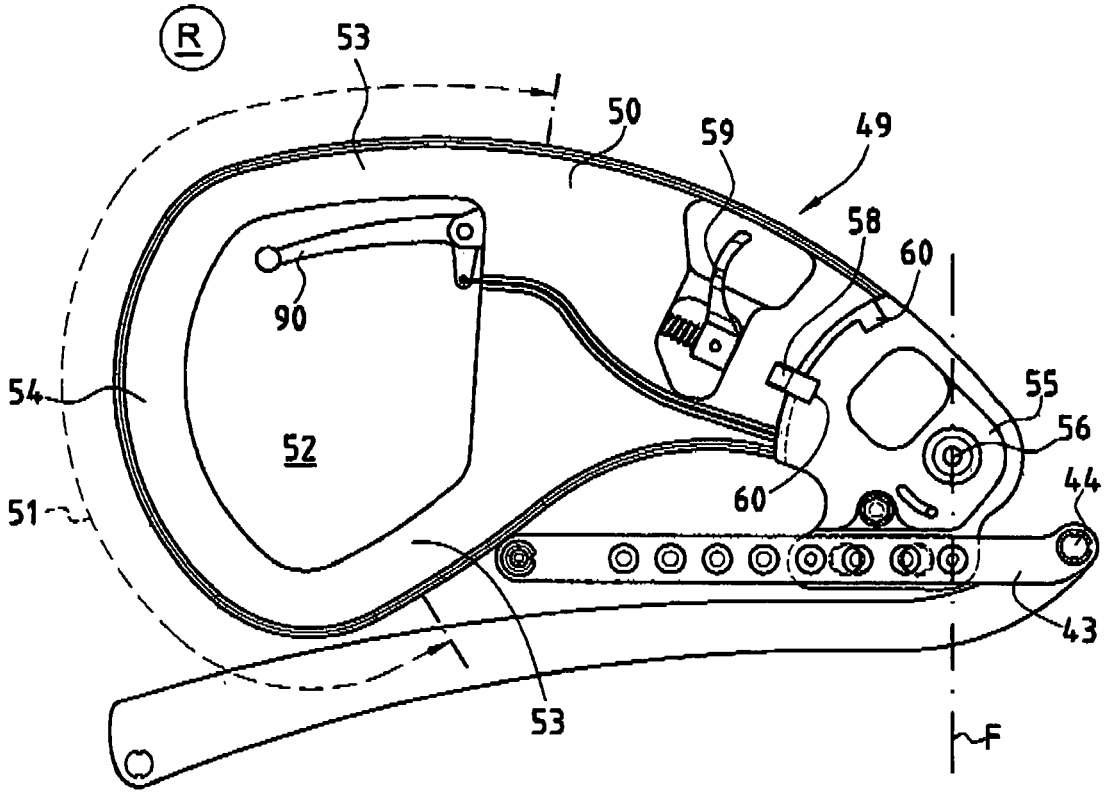
FIG. 8 represents an elevation of a maneuvering handle of a chair according to the invention comprising a control member of a device for assistance in the verticalization—lowering movement of the chair, realized in the form of a lever, of the bicycle brake type handle.

Furthermore, the control member equipping one of the two maneuvering handles 49, is not necessarily comprised of a member that could be qualified as being universal as hereinbefore described but in contrast could be realized in the form of a simple lever 90 as illustrated in FIG. 8, acting on a cable control system.

Naturally, diverse other modifications could be made without departing from the scope of the present invention.

The invention claimed is:

1. A body support chair for physically challenged persons comprising a frame supporting an articulated structure, which comprises a seat, a foot rest, a back as well as two symmetrical lateral articulated systems, each comprising:

a first deformable polygon contributing to the support of the seat, comprising two sills, upper and lower, respectively articulated on the front part of the frame and connected towards their rear parts by a spacer part;

a second deformable polygon contributing to the support of the foot rest;

a back assembly articulated on the first polygon opposite to the second polygon by means of the spacer part, at least;

and a maneuvering assembly interposed between the first polygon and the frame which comprises:

a first lever articulated on the rear part of the frame;

a second lever with two ends, one end being articulated on the first lever and the other end being articulated on the first polygon;

a maneuvering handle which is attached to the second lever and which assumes a function of guidance and control of relative pivoting of the lateral articulated systems from a lowered position to a verticalization position of the articulated structure relative to the frame and vice versa, wherein for each maneuvering assembly, the position of the maneuvering handle is adjustable between the ends of the second lever.

2. The body support chair according to claim 1, wherein each maneuvering handle has a U-shaped gripping zone open at its center and having two arms connected by a bar, the arms and the bar offering a support surface for a hand of a user of the body support chair.

3. The body support chair according to claim 1, wherein one maneuvering handle comprises a command member of an element assisting the pivoting of the lateral articulated systems.

4. The body support chair according to claim 1, wherein for each maneuvering assembly the maneuvering handle comprises a body fitted on a support, whose position between the two ends of the second lever is adjustable.

5. The body support chair according to claim 4, wherein the second lever of each maneuvering assembly comprises a series of fixation holes as means for adjusting the position of the support of the maneuvering handle between the two ends of the second lever.

6. The body support chair according to claim 4 or 5, wherein for each maneuvering assembly, the body of the maneuvering handle is fitted on the support of the maneuvering handle attached to the second lever in such fashion as to be mobile between a resting position (R) and a working position (D).

7. The body support chair according to claim 6, wherein the body of the maneuvering handle is mobile relative to the support of the maneuvering handle in rotation along a substantially horizontal axis included in a frontal plane (F).

8. The body support chair according to claim 6, wherein it comprises means for locking the body of the maneuvering handle in the resting position and/or the working positions.

* * * * *